US010506358B2

(12) United States Patent
Koppens et al.

(10) Patent No.: US 10,506,358 B2
(45) **Date of Patent: *Dec. 10, 2019**

(54) BINAURAL AUDIO PROCESSING

(71) Applicant: KONINKLIJKE PHILIPS N.V., Eindhoven (NL)

(72) Inventors: Jeroen Gerardus Henricus Koppens, Nederweert (NL); Arnoldus Werner Johannes Oomen, Eindhoven (NL); Erik Gosuinus Petrus Schuijers, Breda (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/855,317

(22) Filed: Dec. 27, 2017

(65) Prior Publication Data

US 2018/0124538 A1 May 3, 2018

Related U.S. Application Data

(62) Division of application No. 14/653,278, filed as application No. PCT/IB2013/060760 on Dec. 10, 2013, now Pat. No. 9,860,663.

(Continued)

(51) Int. Cl.
*H04S 1/00* (2006.01)
*H04S 7/00* (2006.01)

(52) U.S. Cl.
CPC ..... *H04S 1/005* (2013.01); *H04S 7/30* (2013.01); *H04S 2400/11* (2013.01); *H04S 2420/01* (2013.01)

(58) Field of Classification Search
CPC . H04S 1/005; H04S 1/00; H04S 1/007; H04S 7/30; H04S 7/306; H04S 2400/11; H04S 2420/01; H04S 2420/03

(Continued)

(56) References Cited

U.S. PATENT DOCUMENTS

2003/0236814 A1 12/2003 Miyasaka
2007/0160218 A1 7/2007 Jakka (Continued)

FOREIGN PATENT DOCUMENTS

EP 2175670 A1 4/2010
JP 2010511910 A 4/2010
WO 2008046531 A1 4/2008

OTHER PUBLICATIONS

Hamilton, "Multi-Dimensional Audio: The Most Revolutionary Technology at CES", Orange County Register, Feb. 12, 2012, 5 Pages.

(Continued)

*Primary Examiner* — Khai N. Nguyen
*Assistant Examiner* — Sabrina Diaz

(57) ABSTRACT

A transmitting device comprises a binaural circuit (601) which provides a plurality of binaural rendering data sets, each binaural rendering data set comprising data representing parameters for a virtual position binaural rendering. Specifically, head related binaural transfer function data may be included in the data sets. A representation circuit (603) provides a representation indication for each of the data sets. The representation indication for a data set is indicative of the representation used by the data set. An output circuit (605) generates a bitstream comprising the data sets and the representation indications. The bitstream is received by a receiver (701) in a receiving device. A selector (703) selects a selected binaural rendering data set based on the representation indications and a capability of the apparatus, and an audio processor (707) processes the audio signal in response to data of the selected binaural rendering data set.

15 Claims, 10 Drawing Sheets

Related U.S. Application Data

(60) Provisional application No. 61/752,488, filed on Jan. 15, 2013.

(58) Field of Classification Search
USPC ..... 381/1–3, 7, 300
See application file for complete search history.

(56) References Cited

U.S. PATENT DOCUMENTS

| | | | |
|---|---|---|---|
| 2007/0297616 | A1 | 12/2007 | Plogsties |
| 2008/0192941 | A1 | 8/2008 | Oh |
| 2008/0205658 | A1 | 8/2008 | Breebaart |
| 2009/0010440 | A1 | 1/2009 | Jung |
| 2009/0012796 | A1 | 1/2009 | Jung |
| 2010/0017002 | A1 | 1/2010 | Oh |
| 2014/0350944 | A1 | 11/2014 | Jot |
| 2015/0213807 | A1 | 7/2015 | Breebaart |

OTHER PUBLICATIONS

Algazi et al, "Headphone-Based Spatial Sound", IEEE Signalprocessing Magazine, vol. 33, 2011, pp. 1-42.

Cheng et al, "Introduction to Head-Related Transfer Functions (HRTF's): Represnetations of HRTF's in Time, Frequency, and Space", Journal Audio Engineering Society, vol. 49, No. 4, 2001, pp. 1-28.

Menzer et al, "Binaural Reverberation Using a Modified Jot Reverberator With Frequency-Dependent Interaural Coherence Matching", 126th Audio Engineering Society Convention, 2009, pp. 1-6.

Breebaart et al, "Spectral and Spatial Parameter Resolution Requirements for Parametric, Filter-Bank-Based HRTF Processing", Journal Audio Engineering Society, vol. 58, No. 3, 2010, pp. 126-140.

Breebaart et al "Multi-Channel Goes Mobile: MPEG Surround Binaural Rendering" AES International Conference, xp007902577, 2006, pp. 1013.

"Draft Call for Proposals on 3D Audio", N13194, 102nd MPEG Meeting, Shanghai, CN 2012, pp. 1-13.

International Standard ISO/IEC 23003-1, Information Technology—MPEG Audio Technologies, Part 1: MPEG Surround, 2012, pp. 1-7.

International Standard ISO/IEC 23003-2, Information Technology—MPEG Audio Technologies, Part 2: Spatial Audio Object Coding (SAOC).

Silva, "The 3D Audio Alliance—Taking Audio Reproduction to the Next Level", http://hometheater.about.com/od/hometheateraudiobasics/a/the-3D-Audio-Alliance-Overview.thm., 2011, pp. 2.

Engdegard et al "Spatial Audio Object Coding (SAOC)—The Upcoming MPEG Standard on Parametric Object based Audio Coding", Audio Engineering Society, Convention Paper 7377, 124th Convention, XP-002541458, 2008, pp. 1-15.

BINAURAL AUDIO PROCESSING

CROSS-REFERENCE TO PRIOR APPLICATIONS

This application is a Divisional Application of U.S. Ser. No. 14/653,278, filed Jun. 18, 2015, which is the U.S. National Phase application under 35 U.S.C. § 371 of International Application No. PCT/IB2013/060760, filed on Dec. 10, 2013, which claims the benefit of U.S. Provisional Patent Application No. 61/752,488, filed on Jan. 15, 2013. These applications are hereby incorporated by reference herein.

FIELD OF THE INVENTION

The invention relates to binaural rendering and in particular, but not exclusively, to communication and processing of head related binaural transfer function data for audio processing applications.

BACKGROUND OF THE INVENTION

Digital encoding of various source signals has become increasingly important over the last decades as digital signal representation and communication increasingly has replaced analogue representation and communication. For example, audio content, such as speech and music, is increasingly based on digital content encoding. Furthermore, audio consumption has increasingly become an enveloping three dimensional experience with e.g. surround sound and home cinema setups becoming prevalent.

Audio encoding formats have been developed to provide increasingly capable, varied and flexible audio services and in particular audio encoding formats supporting spatial audio services have been developed.

Well known audio coding technologies like DTS and Dolby Digital produce a coded multi-channel audio signal that represents the spatial image as a number of channels that are placed around the listener at fixed positions. For a speaker setup which is different from the setup that corresponds to the multi-channel signal, the spatial image will be suboptimal. Also, channel based audio coding systems are typically not able to cope with a different number of speakers.

(ISO/IEC MPEG-D) MPEG Surround provides a multichannel audio coding tool that allows existing mono- or stereo-based coders to be extended to multi-channel audio applications. FIG. 1 illustrates an example of the elements of an MPEG Surround system. Using spatial parameters obtained by analysis of the original multichannel input, an MPEG Surround decoder can recreate the spatial image by a controlled upmix of the mono- or stereo signal to obtain a multichannel output signal.

Since the spatial image of the multi-channel input signal is parameterized, MPEG Surround allows for decoding of the same multi-channel bit-stream by rendering devices that do not use a multichannel speaker setup. An example is virtual surround reproduction on headphones, which is referred to as the MPEG Surround binaural decoding process. In this mode a realistic surround experience can be provided while using regular headphones. Another example is the pruning of higher order multichannel outputs, e.g. 7.1 channels, to lower order setups, e.g. 5.1 channels.

Indeed, the variation and flexibility in the rendering configurations used for rendering spatial sound has increased significantly in recent years with more and more reproduction formats becoming available to the mainstream consumer. This requires a flexible representation of audio. Important steps have been taken with the introduction of the MPEG Surround codec. Nevertheless, audio is still produced and transmitted for a specific loudspeaker setup, e.g. an ITU 5.1 speaker setup. Reproduction over different setups and over non-standard (i.e. flexible or user-defined) speaker setups is not specified. Indeed, there is a desire to make audio encoding and representation increasingly independent of specific predetermined and nominal speaker setups. It is increasingly preferred that flexible adaptation to a wide variety of different speaker setups can be performed at the decoder/rendering side.

In order to provide for a more flexible representation of audio, MPEG standardized a format known as 'Spatial Audio Object Coding' (ISO/IEC MPEG-D SAOC). In contrast to multichannel audio coding systems such as DTS, Dolby Digital and MPEG Surround, SAOC provides efficient coding of individual audio objects rather than audio channels. Whereas in MPEG Surround, each speaker channel can be considered to originate from a different mix of sound objects, SAOC makes individual sound objects available at the decoder side for interactive manipulation as illustrated in FIG. 2. In SAOC, multiple sound objects are coded into a mono or stereo downmix together with parametric data allowing the sound objects to be extracted at the rendering side thereby allowing the individual audio objects to be available for manipulation e.g. by the end-user.

Indeed, similarly to MPEG Surround, SAOC also creates a mono or stereo downmix. In addition object parameters are calculated and included. At the decoder side, the user may manipulate these parameters to control various features of the individual objects, such as position, level, equalization, or even to apply effects such as reverb. FIG. 3 illustrates an interactive interface that enables the user to control the individual objects contained in an SAOC bitstream. By means of a rendering matrix individual sound objects are mapped onto speaker channels.

SAOC allows a more flexible approach and in particular allows more rendering based adaptability by transmitting audio objects in addition to only reproduction channels. This allows the decoder-side to place the audio objects at arbitrary positions in space, provided that the space is adequately covered by speakers. This way there is no relation between the transmitted audio and the reproduction or rendering setup, hence arbitrary speaker setups can be used. This is advantageous for e.g. home cinema setups in a typical living room, where the speakers are almost never at the intended positions. In SAOC, it is decided at the decoder side where the objects are placed in the sound scene, which is often not desired from an artistic point-of-view. The SAOC standard does provide ways to transmit a default rendering matrix in the bitstream, eliminating the decoder responsibility. However the provided methods rely on either fixed reproduction setups or on unspecified syntax. Thus SAOC does not provide normative means to fully transmit an audio scene independently of the speaker setup. Also, SAOC is not well equipped to the faithful rendering of diffuse signal components. Although there is the possibility to include a so called Multichannel Background Object (MBO) to capture the diffuse sound, this object is tied to one specific speaker configuration.

Another specification for an audio format for 3D audio is being developed by the 3D Audio Alliance (3DAA) which is an industry alliance. 3DAA is dedicated to develop standards for the transmission of 3D audio, that "will facilitate the transition from the current speaker feed paradigm to a flexible object-based approach". In 3DAA, a bitstream format is to be defined that allows the transmission of a legacy multichannel downmix along with individual sound objects. In addition, object positioning data is included. The principle of generating a 3DAA audio stream is illustrated in FIG. 4.

In the 3DAA approach, the sound objects are received separately in the extension stream and these may be extracted from the multi-channel downmix. The resulting multi-channel downmix is rendered together with the individually available objects.

The objects may consist of so called stems. These stems are basically grouped (downmixed) tracks or objects. Hence, an object may consist of multiple sub-objects packed into a stem. In 3DAA, a multichannel reference mix can be transmitted with a selection of audio objects. 3DAA transmits the 3D positional data for each object. The objects can then be extracted using the 3D positional data. Alternatively, the inverse mix-matrix may be transmitted, describing the relation between the objects and the reference mix.

From the description of 3DAA, sound-scene information is likely transmitted by assigning an angle and distance to each object, indicating where the object should be placed relative to e.g. the default forward direction. Thus, positional information is transmitted for each object. This is useful for point-sources but fails to describe wide sources (like e.g. a choir or applause) or diffuse sound fields (such as ambiance). When all point-sources are extracted from the reference mix, an ambient multichannel mix remains. Similar to SAOC, the residual in 3DAA is fixed to a specific speaker setup.

Thus, both the SAOC and 3DAA approaches incorporate the transmission of individual audio objects that can be individually manipulated at the decoder side. A difference between the two approaches is that SAOC provides information on the audio objects by providing parameters characterizing the objects relative to the downmix (i.e. such that the audio objects are generated from the downmix at the decoder side) whereas 3DAA provides audio objects as full and separate audio objects (i.e. that can be generated independently from the downmix at the decoder side). For both approaches, position data may be communicated for the audio objects.

Binaural processing where a spatial experience is created by virtual positioning of sound sources using individual signals for the listener's ears is becoming increasingly widespread. Virtual surround is a method of rendering the sound such that audio sources are perceived as originating from a specific direction, thereby creating the illusion of listening to a physical surround sound setup (e.g. 5.1 speakers) or environment (concert). With an appropriate binaural rendering processing, the signals required at the eardrums for the listener to perceive sound from any direction can be calculated and the signals rendered such that they provide the desired effect. As illustrated in FIG. 5, these signals are then recreated at the eardrum using either headphones or a crosstalk cancelation method (suitable for rendering over closely spaced speakers).

Next to the direct rendering of FIG. 5, specific technologies that can be used to render virtual surround include MPEG Surround and Spatial Audio Object Coding, as well as the upcoming work item on 3D Audio in MPEG. These technologies provide for a computationally efficient virtual surround rendering.

The binaural rendering is based on binaural filters which vary from person to person due to different acoustic properties of the head and reflective surfaces such as the shoulders. For example, binaural filters can be used to create a binaural recording simulating multiple sources at various locations. This can be realized by convolving each sound source with the pair of Head Related Impulse Responses (HRIRs) that corresponds to the position of the sound source.

By measuring e.g. the impulse responses from a sound source at a specific location in 2D or 3D space at microphones placed in or near the human ears, the appropriate binaural filters can be determined. Typically, such measurements are made e.g. using models of human heads, or indeed in some cases the measurements may be made by attaching microphones close to the eardrums of a person. The binaural filters can be used to create a binaural recording simulating multiple sources at various locations. This can be realized e.g. by convolving each sound source with the pair of measured impulse responses for a position at the desired position of the sound source. In order to create the illusion that a sound source is moved around the listener, a large number of binaural filters is required with adequate spatial resolution, e.g. 10 degrees.

The binaural filter functions may be represented e.g. as a Head Related Impulse Responses (HRIR) or equivalently as Head Related Transfer Functions (HRTFs) or a Binaural Room Impulse Response (BRIR) or a Binaural Room Transfer Function (BRTF). The (e.g. estimated or assumed) transfer function from a given position to the listener's ears (or eardrums) is known as a head related binaural transfer function. This function may for example be given in the frequency domain in which case it is typically referred to as an HRTF or BRTF or in the time domain in which case it is typically referred to as a HRIR or BRIR. In some scenarios, the head related binaural transfer functions are determined to include aspects or properties factors of the acoustic environment and specifically of the room in which the measurements are made whereas in other examples only the user characteristics are considered. Examples of the first type of functions are the BRIRs and BRTFs, and examples of the latter type of functions are the HRIR and HRTF.

Accordingly, the underlying head related binaural transfer function can be represented in many different ways including HRIRs, HRTFs, etc. Furthermore, for each of these main representations, there are a large number of different ways to represent the specific function, e.g. with different levels of accuracy and complexity. Different processors may use different approaches and thus be based on different representations. Thus, a large number of head related binaural transfer functions are typically required in any audio system. Indeed, a large variety of how to represent head related binaural transfer functions exist and this is further exacerbated by a large variability of possible parameters for each head related binaural transfer functions. For example, a BRIR may sometimes be represented by a FIR filter with, say, 9 taps but in other scenarios by a FIR filter with, say, 16 taps etc. As another example, HRTFs can be represented in the frequency domain using a parameterized representation where a small set of parameters is used to represent a complete frequency spectrum.

It is in many scenarios desirable to allow for communicating parameters of a desired binaural rendering, such as the specific head related binaural transfer functions that may be used. However, due to the large variability in possible representations of the underlying head related binaural transfer function, it may be difficult to ensure commonality between the originating and receiving devices.

The Audio Engineering Society (AES) sc-02 technical committee has recently announced the start of a new project on the standardization of a file format to exchange binaural listening parameters in the form of head related binaural transfer functions. The format will be scalable to match the available rendering process. The format will be designed to include source materials from different HRTF databases. A challenge exists in how such multiple head related binaural transfer functions can be best supported, used and distributed in an audio system.

Accordingly, an improved approach for supporting binaural processing, and especially for communicating data for binaural rendering would be desired. In particular, an approach allowing improved representation and communication of binaural rendering data, reduced data rate, reduced overhead, facilitated implementation, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an apparatus for processing an audio signal, the apparatus comprising: a receiver for receiving input data, the input data comprising a plurality of binaural rendering data sets, each binaural rendering data set comprising data representing parameters for a virtual position binaural rendering processing and providing a different representation of the same underlying head related binaural transfer function, the input data further, for each of the binaural rendering data sets, comprising a representation indication indicative of a representation for the binaural rendering data set; a selector for selecting a selected binaural rendering data set in response to the representation indications and a capability of the apparatus; an audio processor for processing the audio signal in response to data of the selected binaural rendering data set, wherein at least some representations for the binaural rendering data sets correspond to different binaural audio processing algorithms, and the selection of the selected binaural rendering data set is dependent on a binaural processing algorithm used by the audio processor.

The invention may allow improved and/or more flexible and/or less complex binaural processing in many scenarios. The approach may in particular allow a flexible and/or low complexity approach for communicating and representing a variety of binaural rendering parameters. The approach may allow a variety of binaural rendering approaches and parameters to be efficiently represented in the same bitstream/data file with an apparatus receiving the data being able to select appropriate data and representations with low complexity. In particular, a suitable binaural rendering that matches the capability of the apparatus can be easily identified and selected without requiring a complete decoding of all data, or indeed in many embodiments without any decoding of data of any of the binaural rendering data set.

A virtual position binaural rendering processing may be any processing of an algorithm or process which for a signal representing a sound source generates audio signals for the two ears of a person such that the sound is perceived to originate from a desired position in 3D space, and typically from a desired position outside the user's head.

Each data set may comprise data representing parameters of at least one virtual position binaural rendering operation. Each data set may relate only to a subset of the total parameters that control or affect a binaural rendering. The data may define or describe one or more parameters completely, and/or may e.g. partly define one or more parameters. In some embodiments, the defined parameters may be preferred parameters.

A representation indication may define which parameters are included in the data sets and/or a characteristic of the parameters and/or how the parameters are described by the data.

The capability of the apparatus may for example be a computational or memory resource limitation. The capability may be determined dynamically or may be a static parameter.

In accordance with an optional feature of the invention, the binaural rendering data sets comprise head related binaural transfer function data.

The invention may allow improved and/or facilitated and more flexible distribution of head related binaural transfer functions and/or processing based on head related binaural transfer functions. In particular, the approach may allow data representing a large variety of head related binaural transfer functions to be distributed with individual processing apparatuses being able to easily and efficiently identify and extract data specifically suitable for that processing apparatus.

The representation indications may be, or may comprise, indications of the representation of the head related binaural transfer functions, such as the nature of the head related binaural transfer function as well as individual parameters thereof. For example, the representation indication for a given binaural rendering data set may indicate whether the data set provides a representation of a head related binaural transfer function as a HRTF, BRTF, HRIR or BRIR. For an impulse response representation, the representation indication may for example indicate number of taps (coefficients) for a FIR filter representing the impulse response, and/or the number of bits used for each tap. For a frequency domain representation, the representation indication may for example indicate the number of frequency intervals for which a coefficient is provided, whether the frequency bands are linear or e.g. Bark frequency bands, etc.

The processing of the audio signal may be a virtual position binaural rendering processing based on parameters of a head related binaural transfer function retrieved from the selected binaural rendering data set.

In accordance with an optional feature of the invention, at least one of the binaural rendering data sets comprises head related binaural transfer function data for a plurality of positions.

In some embodiments, each binaural rendering data set may for example define a full set of head related binaural transfer functions for a two or three dimensional sound source rendering space. A representation indication which is common for all positions may allow an efficient representation and communication.

In accordance with an optional feature of the invention, the representation indications further represent an ordered sequence of the binaural rendering data set, the ordered sequence being ordered in terms of at least one of quality and complexity for a binaural rendering represented by the binaural rendering data sets, and the selector is arranged to select the selected binaural rendering data set in response to a position of the selected binaural rendering data set in the ordered sequence.

This may provide a particularly advantageous operation in many embodiments. In particular, it may facilitate and/or improve the process of selecting the selected binaural rendering data set as this may be done taken into account the order of the representation indications.

In some embodiments, the order of the representation indications is represented by the positions of the representation indications in the bitstream.

This may facilitate the selection process. For example, the representation indications may be evaluated in accordance with the order in which they are positioned in the input data bit stream, and the data set of the selected suitable representation indication may be selected without any consideration of any further representation indications. If the representation indications are positioned in order of decreasing preference (according to any suitable parameter), this will result in the preferred representation indication and thus binaural rendering data set being selected.

In some embodiments, the order of the representation indications is represented by an indication comprised in the input data. The indication for each representation indications may be comprised in the representation indication. The indication may for example be an indication of a priority.

This may facilitate the selection process. For example, a priority may be provided as the first couple of bits of each representation indication. The apparatus may first scan the bitstream for the highest possible priority, and may from these representation indications evaluate whether they match the capability of the apparatus. If so, one of the representation indications, and the corresponding binaural rendering data set, is selected. If not, the apparatus may proceed to scan the bitstream for the second highest possible priority, and then perform the same evaluation for these representation indications. This process may be continued until a suitable binaural rendering data set is identified.

In some embodiments, the data sets/representation indications may be ordered in order of quality of the binaural rendering represented by the parameters of the associated/linked binaural rendering data set.

The order may be of increasing or decreasing quality depending on the specific embodiments, preferences and applications.

This may provide a particularly efficient system. For example, the apparatus may simply process the representation indications in the given order until a representation indication indicating a representation of the binaural rendering data set which matches the capability of the apparatus. The apparatus may then select this representation indication and corresponding binaural rendering data set, as this will represent the highest quality rendering possible for the provided data and the capabilities of the apparatus.

In some embodiments, the data sets/representation indications may be ordered in order of complexity of the binaural rendering represented by the parameters of the binaural rendering data set.

The order may be of increasing or decreasing complexity depending on the specific embodiments, preferences and applications.

This may provide a particularly efficient system. For example, the apparatus may simply process the representation indications in the given order until a representation indication indicating a representation of the binaural rendering data set which matches the capability of the apparatus. The apparatus may then select this representation indication and corresponding binaural rendering data set, as this will represent the lowest complexity rendering possible for the provided data and the capabilities of the apparatus.

In some embodiments, the data sets/representation indications may be ordered in order of a combined characteristic of the binaural rendering represented by the parameters of the binaural rendering data set. For example, a cost value may be expressed as a combination of a quality measure and a complexity measure for each binaural rendering data set, and the representation indications may be ordered according to this cost value.

In accordance with an optional feature of the invention, the selector is arranged to select the selected binaural rendering data set as the binaural rendering data set for the first representation indication in the ordered sequence which indicates a rendering processing of which the audio processor is capable.

This may reduce complexity and/or facilitate selection.

In accordance with an optional feature of the invention, the representation indications comprise an indication of a head related filter type represented by the binaural rendering data set.

In particular, the representation indication for a given binaural rendering data set may comprise an indication of e.g. HRTFs, BRTFs, HRIRs or BRIRs being represented by the binaural rendering data set.

In accordance with an optional feature of the invention, at least some of the plurality of binaural rendering data sets includes at least one head related binaural transfer function described by a representation selected from the group of: a time domain impulse response representation; a frequency domain filter transfer function representation; a parametric representation; and a sub-band domain filter representation.

This may provide a particularly advantageous system in many scenarios.

In some embodiments, a value of the representation indication is a value from a set of options. The input data may comprise at least two representation indications with different values from the set of options. The options may for example include one or more of: a time domain impulse response representation; a frequency domain filter transfer function representation; a parametric representation; a sub-band domain filter representation, a FIR filter representation.

At least some representations for the binaural rendering data sets correspond to different binaural audio processing algorithms, and the selection of the selected binaural rendering data set is dependent on a binaural processing algorithm used by the audio processor.

This may allow particularly efficient operation in many embodiments. For example, the apparatus may be programmed to perform a specific rendering algorithm based on HRTF filters. In this case, the representation indications may be evaluated to identify binaural rendering data sets which comprise suitable HRTF data.

The audio processor is arranged to adapt the processing of the audio signal depending on the representation used by the selected binaural rendering data set. For example, the number of coefficients in an adaptable FIR filter used for HRTF processing may be adapted based on an indication of the number of taps provided by the selected binaural rendering data set.

In accordance with an optional feature of the invention, at least some binaural rendering data sets comprise reverberation data, and the audio processor is arranged to adapt a reverberation processing dependent on the reverberation data of the selected binaural rendering data set.

This may provide particularly advantageous binaural sound, and may provide an improved user experience and sound stage perception.

In accordance with an optional feature of the invention, the audio processor is arranged to perform a binaural rendering processing which includes generating a processed audio signal as a combination of at least a head related binaural transfer function filtered signal and a reverberation signal, and wherein the reverberation signal is dependent on data of the selected binaural rendering data set.

This may provide a particularly efficient implementation, and may provide a highly flexible and adaptable processing and provision of binaural rendering processing data.

In many embodiments, the head related binaural transfer function filtered signal is not dependent on data of the selected binaural rendering data set. Indeed, in many embodiments, the input data may comprise head related binaural transfer function filter data which is common for a plurality of binaural rendering data sets, but with reverberation data which is individual to the individual binaural rendering data set.

In accordance with an optional feature of the invention, the selector is arranged to select the selected binaural rendering data set in response to indications of representations of reverberation data as indicated by the representation indications.

This may provide a particularly advantageous approach. In some embodiments, the selector may be arranged to select the selected binaural rendering data set in response to indications of representations of reverberation data indicated by the representation indications but not in response to indications of representations of head related binaural transfer function filters indicated by the representation indications.

In accordance with an aspect of the invention, there is provided an apparatus for generating a bitstream, the apparatus comprising: a binaural circuit for providing a plurality of binaural rendering data sets, each binaural rendering data set comprising data representing parameters for a virtual position binaural rendering processing and providing a different representation of the same underlying head related binaural transfer function, a representation circuit for providing, for each of the binaural rendering data sets, a representation indication indicative of a representation for the binaural rendering data set; and an output circuit for generating a bitstream comprising the binaural rendering data sets and the representation indications, wherein at least some representations for the binaural rendering data sets correspond to different binaural audio processing algorithms.

The invention may allow improved and/or more flexible and/or less complex generation of a bitstream providing information on virtual position rendering. The approach may in particular allow for a flexible and/or low complexity approach for communicating and representing a variety of binaural rendering parameters. The approach may allow a variety of binaural rendering approaches and parameters to be efficiently represented in the same bitstream/data file with an apparatus receiving the bitstream/data file being able to select appropriate data and representations with low complexities. In particular, a suitable binaural rendering which matches the capability of the apparatus can be easily identified and selected without requiring a complete decoding of all data, or indeed in many embodiments without any decoding of data of any of the binaural rendering data sets.

Each data set may comprise data representing parameters of at least one virtual position binaural rendering operation. Each data set may relate only to a subset of the total parameters that control or affect a binaural rendering. The data may define or describe one or more parameters completely, and/or may e.g. partly define one or more parameters. In some embodiments, the defined parameters may be preferred parameters.

The representation indication may define which parameters are included in the data sets and/or a characteristic of the parameters and/or how the parameters are described by the data.

In accordance with an optional feature of the invention, the output circuit is arranged to order the representation indications in order of a measure of a characteristic of a virtual position binaural rendering represented by the parameters of the binaural rendering data sets.

This may provide particularly advantageous operation in many embodiments.

According to an aspect of the invention there is provided a method of processing audio, the method comprising: receiving input data, the input data comprising a plurality of binaural rendering data sets, each binaural rendering data set comprising data representing parameters for a virtual position binaural rendering processing and providing a different representation of the same underlying head related binaural transfer function, the input data further, for each of the binaural rendering data sets, comprising a representation indication indicative of a representation for the binaural rendering data set; selecting a selected binaural rendering data set in response to the representation indications and a capability of the apparatus; and processing an audio signal in response to data of the selected binaural rendering data set, wherein at least some representations for the binaural rendering data sets correspond to different binaural audio processing algorithms, and the selection of the selected binaural rendering data set is dependent on a binaural processing algorithm used by the audio processor.

According to an aspect of the invention there is provided a method of generating a bitstream, the method comprising: providing a plurality of binaural rendering data sets, each binaural rendering data set comprising data representing parameters for a virtual position binaural rendering processing and providing a different representation of the same underlying head related binaural transfer function, providing, for each of the binaural rendering data sets, a representation indication indicative of a representation for the binaural rendering data set; generating a bitstream comprising the binaural rendering data sets and the representation indication, wherein at least some representations for the binaural rendering data sets correspond to different binaural audio processing algorithms.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a communication of head related binaural transfer function data, and in particular to communication of HRTFs. However, it will be appreciated that the invention is not limited to this application but may be applied to other binaural rendering data.

Transmission of data describing head related binaural transfer function is receiving increasing interest and as previously mentioned, the AES SC is initiating a new project aimed at developing suitable file formats for communicating such data. The underlying head related binaural transfer functions can be represented in many different ways. For example, HRTF filters come in multiple formats/representations, such as parameterized representations, FIR representations, etc. It is therefore advantageous to have a head related binaural transfer function file format that supports different representation formats for the same underlying head related binaural transfer function. Further, different decoders may rely on different representations, and it is therefore not known by the transmitter which representations must be provided to the individual audio processors. The following description focusses on a system wherein different head related binaural transfer function representation formats can be used within a single file format. The audio processor may select from the multiple representations in order to retrieve a representation which best suits the individual requirements or preferences of the audio processor.

The approach specifically allows multiple representation formats (such as FIR, parametric etc.) of a single head related binaural transfer function within a single head related binaural transfer function file. The head related binaural transfer function file may also comprise a plurality of head related binaural transfer functions with each function being represented by multiple representations. For example, multiple head related binaural transfer function representations may be provided for each of a plurality of positions. The system is furthermore based on the file including representation indications which identify the specific representation that is used for the different data sets representing a head related binaural transfer function. This allows the decoder to select a head related binaural transfer function representation format without needing to access or process the HRTF data itself.

Figure 1:
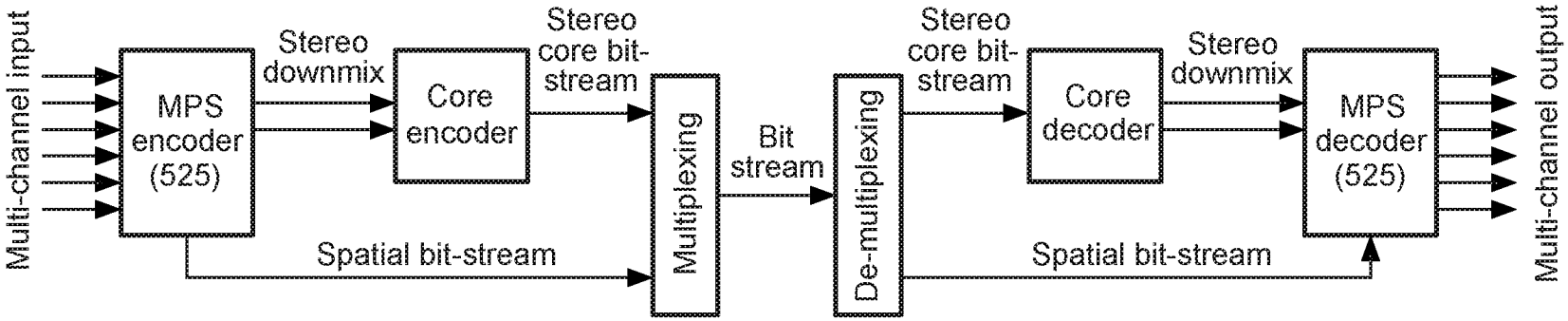
FIG. 1 PRIOR ART
FIG. 1 illustrates an example of elements of an MPEG Surround system.
Figure 2:
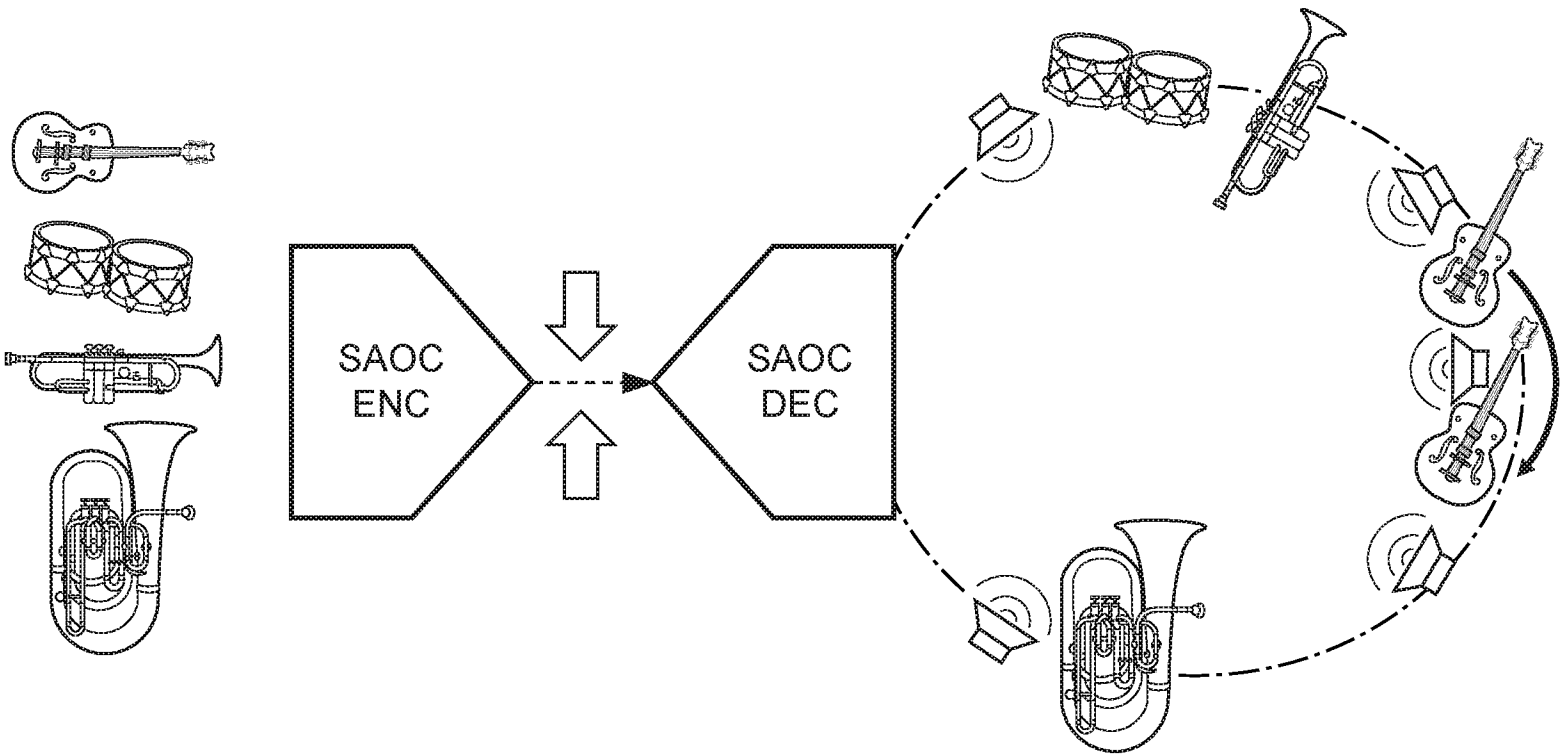
FIG. 2 PRIOR ART
FIG. 2 exemplifies the manipulation of audio objects possible in MPEG SAOC.
Figure 3:
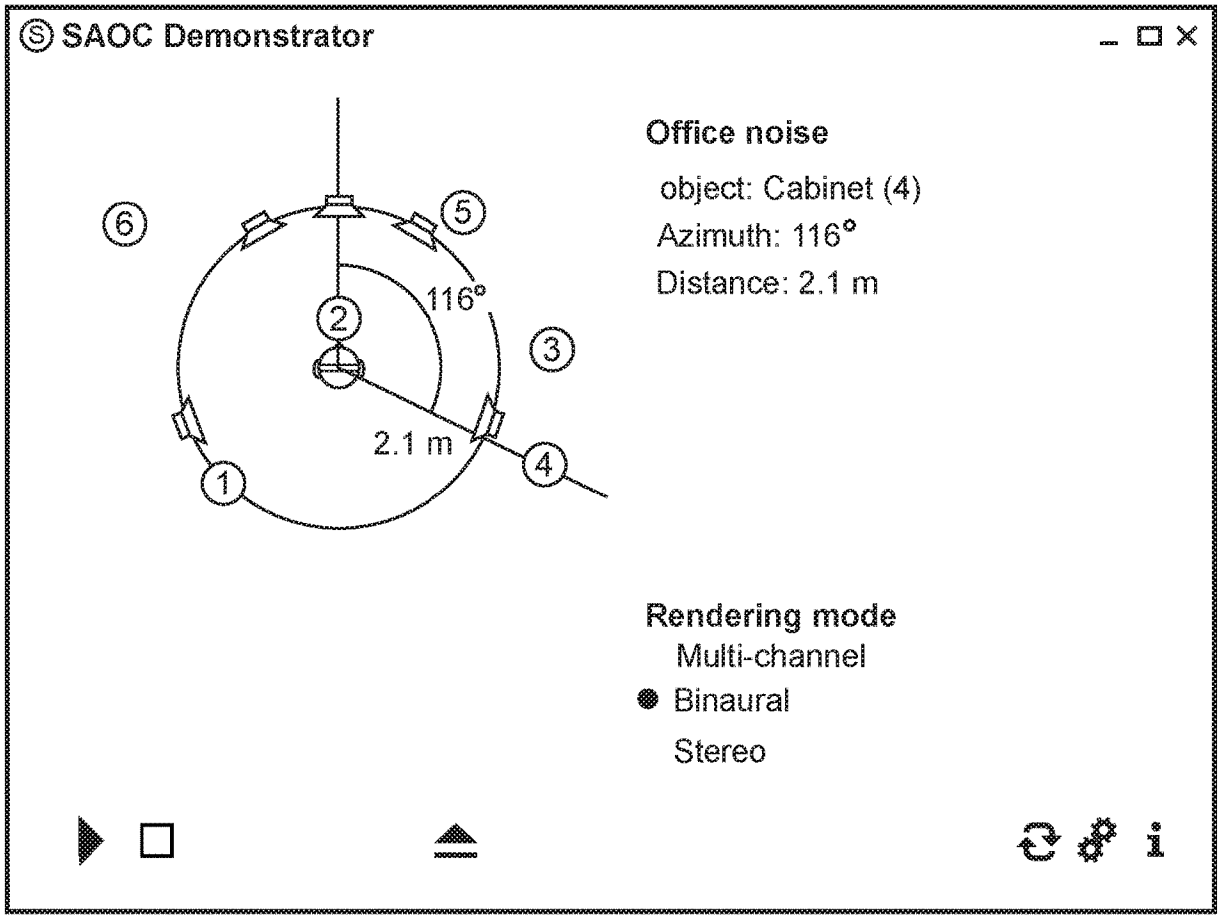
FIG. 3 PRIOR ART
FIG. 3 illustrates an interactive interface that enables the user to control the individual objects contained in an SAOC bitstream.
Figure 4:
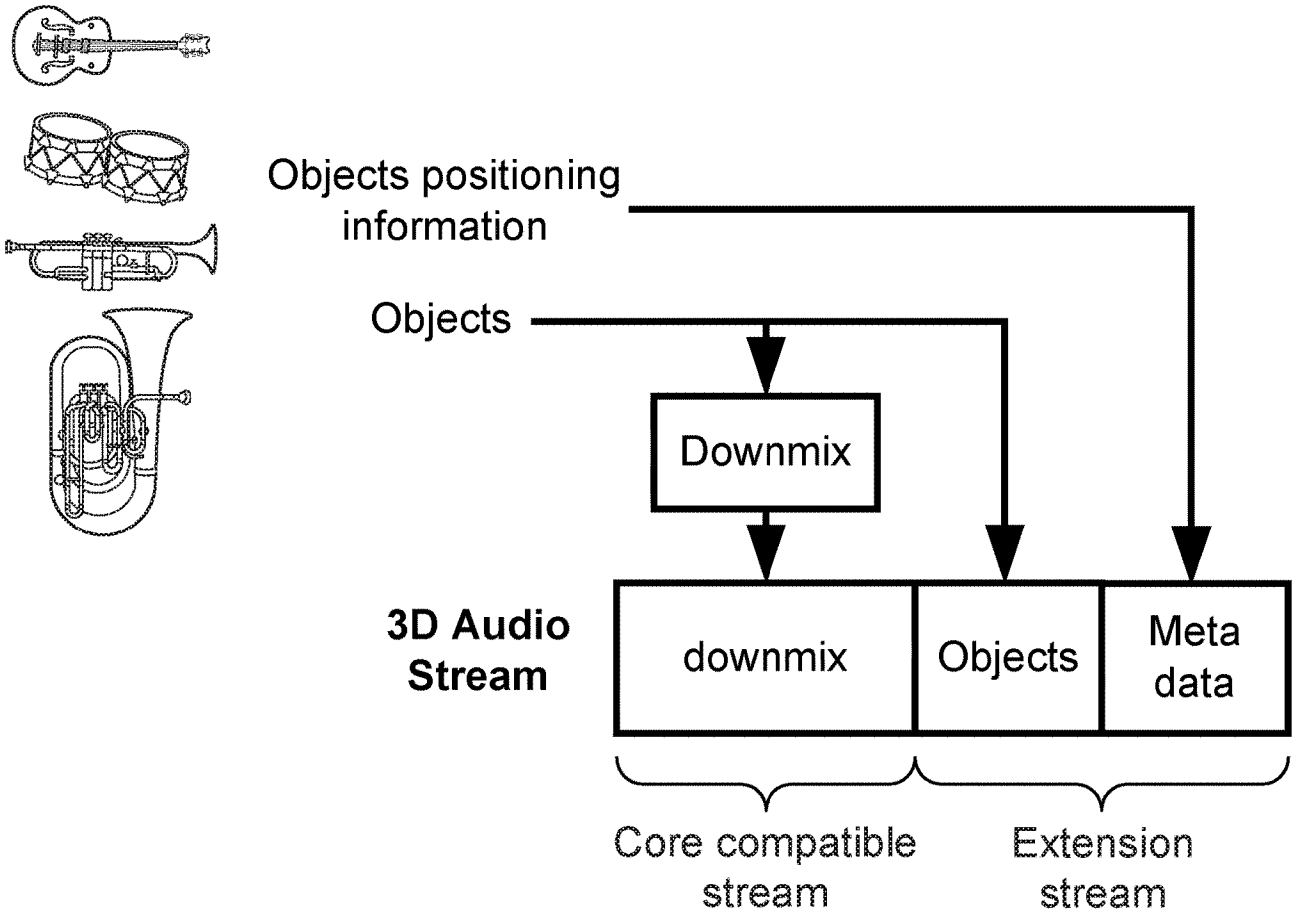
FIG. 4 PRIOR ART
FIG. 4 illustrates an example of the principle of audio encoding of 3DAA.
Figure 5:
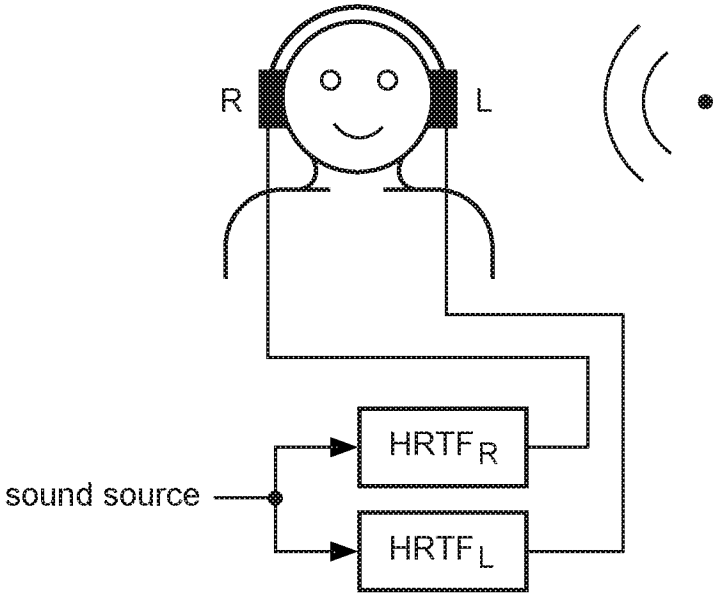
FIG. 5 PRIOR ART
FIG. 5 illustrates an example of binaural processing.
Figure 6:
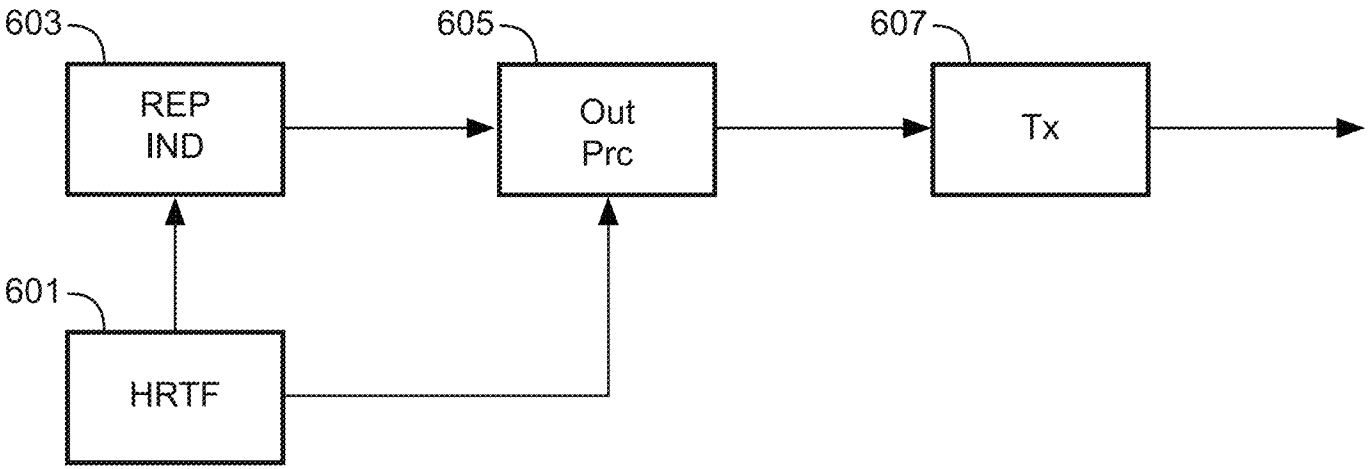
FIG. 6 illustrates an example of a transmitter of head related binaural transfer function data in accordance with some embodiments of the invention.

FIG. 6 illustrates an example of a transmitter for generating and transmitting a bitstream comprising head related binaural transfer function data.

The transmitter comprises an HRTF generator 601 which generates a plurality of head related binaural transfer functions, which in the specific example are HRTFs but which in other embodiments may additionally or alternatively be e.g. HRIRs, BRIRs or BRTFs. Indeed, in the following the term HRTF will for brevity refer to any representation of a head related binaural transfer function, including HRIRs, BRIRs or BRTFs as appropriate.

Each of the HRTFs is then represented by a data set, with each of the data sets providing one representation of one HRTF. More information on specific representations of head related binaural transfer functions may for example be found in:

"Algazi, V. R., Duda, R. O. (2011). "Headphone-Based Spatial Sound", IEEE Signal Processing Magazine, Vol: 28(1), 2011, Page: 33-42", which describes concepts of HRIR, BRIR, HRTF, BRTFs.

"Cheng, C., Wakefield, G. H., "Introduction to Head-Related Transfer Functions (HRTFs): Representations of HRTFs in Time, Frequency, and Space", Journal Audio Engineering Society, Vol: 49, No. 4, April 2001.", which describes different binaural transfer function representations (in time and frequency).

"Breebaart, J., Nater, F., Kohlrausch, A. (2010). "Spectral and spatial parameter resolution requirements for parametric, filter-bank-based HRTF processing" J. Audio Eng. Soc., 58 No 3, p. 126-140.", which references a parametric representation of HRTF data (as used in MPEG Surround/SAOC).

"Menzer, F., Faller, C., "Binaural reverberation using a modified Jot reverberator with frequency-dependent interaural coherence matching", 126th Audio Engineering Society Convention, Munich, Germany, May 7-10, 2009", which describes the Jot reverberator is described. Direct transmission of the filter coefficients of the different filters making up the Jot reverberator may be one way to describe the parameters of the Jot reverberator.

For example, for one HRTF, a plurality of binaural rendering data sets is generated with each data set comprising one representation of the HRTF. E.g., one data set may represent the HRTF by a set of taps for a FIR filter whereas another data set may represent the HRTF with another set of taps for a FIR filter, for example with a different number of coefficients and/or with a different number of bits for each coefficient. Another data set may represent the binaural filter by a set of sub-band (e.g. FFT) frequency domain coefficients. Yet another data set may represent the HRTF with a different set of sub-band (FFT) domain coefficients, such as coefficients for different frequency intervals and/or with a different number of bits for each coefficient. Another data set may represent the HRTF by a set of QMF frequency domain filter coefficients. Yet another data set may provide a parametric representation of the HRTF, and yet another data set may provide a different parametric representation of the HRTF. A parametric representation may provide a set of frequency domain coefficients for a set of fixed or non-constant frequency intervals, such as e.g. a set or frequency bands according to the Bark scale or ERB scale.

Thus, the HRTF generator 601 generates a plurality of data sets for each HRTF with each data set providing a representation of the HRTF. Furthermore, the HRTF generator 601 generates data sets for a plurality of positions. For example, the HRTF generator 601 may generate data sets for a plurality of HRTFs covering a set of three dimensional or two dimensional positions. The combined positions may thus provide a set of HRTFs that can be used by an audio processor to process an audio signal using a virtual positioning binaural rendering algorithm, resulting in the audio signal being perceived as a sound source at a given position. Based on the desired position, the audio processor can extract the appropriate HRTF and apply this in the rendering process (or may e.g. extract two HRTFs and generate the HRTF to use by interpolation of the extracted HRTFs).

The HRTF generator 601 is coupled to an indication processor 603 which is arranged to generate a representation indication for each of the HRTF data sets. Each of the representation indications indicates which representation of the HRTF is used by the individual data set.

Each representation indication may in some embodiments be generated to consist in a few bits that define the used representation in accordance with e.g. a predetermined syntax. The representation may for example include a few bits defining whether the data set describes the HRTF by taps of a FIR filter, coefficients for an FFT domain filter, coefficients for a QMF filter, a parametric representation etc. The representation indication may e.g. in some embodiments include a few bits defining how many data values are used in the representation (e.g. how many taps or coefficients are used to define a binaural rendering filter). In some embodiments, the representation indications may include a few bits defining the number of bits used for each data value (e.g. for each filter coefficient or tap).

The HRTF generator 601 and the indication processor 603 are coupled to an output processor 605 which is arranged to generate a bitstream which comprises the representation indications and the data sets.

In many embodiments, the output processor 605 is arranged to generate the bitstream as comprising a series of representation indications and a series of data sets. In other embodiments, the representation indications and data sets may be interleaved, e.g. with the data of each data set being immediately preceded by the representation indication for that data set. This may e.g. provide the advantage that no data is needed to indicate which representation indication is linked to which data set.

The output processor 605 may further include other data, headers, synchronization data, control data etc. as will be known to the person skilled in the art.

The generated data stream may be included in a data file which may e.g. be stored in memory or on a storage medium, such as a memory stick or DVD. In the example of FIG. 6, the output processor 605 is coupled to a transmitter 607 which is arranged to transmit the bitstream to a plurality of receivers over a suitable communication network. Specifically, the transmitter 607 may transmit the bitstream to a receiver using the Internet.

Thus, the transmitter of FIG. 6 generates a bitstream which comprises a plurality of binaural rendering data sets, which in the specific example are HRTF data sets. Each binaural rendering data set comprises data representing parameters of at least one binaural virtual position rendering processing. Specifically, it may comprise data specifying a filter to be used for binaural spatial rendering. For each binaural rendering data set, the bitstream further comprises a representation indication which for each binaural rendering data set is indicative of a representation used by the binaural rendering data set.

In many embodiments, the bitstream may also include audio data to be rendered, such as for example MPEG Surround, MPEG SAOC, or 3DAA audio data. This data may then be rendered using the binaural data from the data sets.

Figure 7:
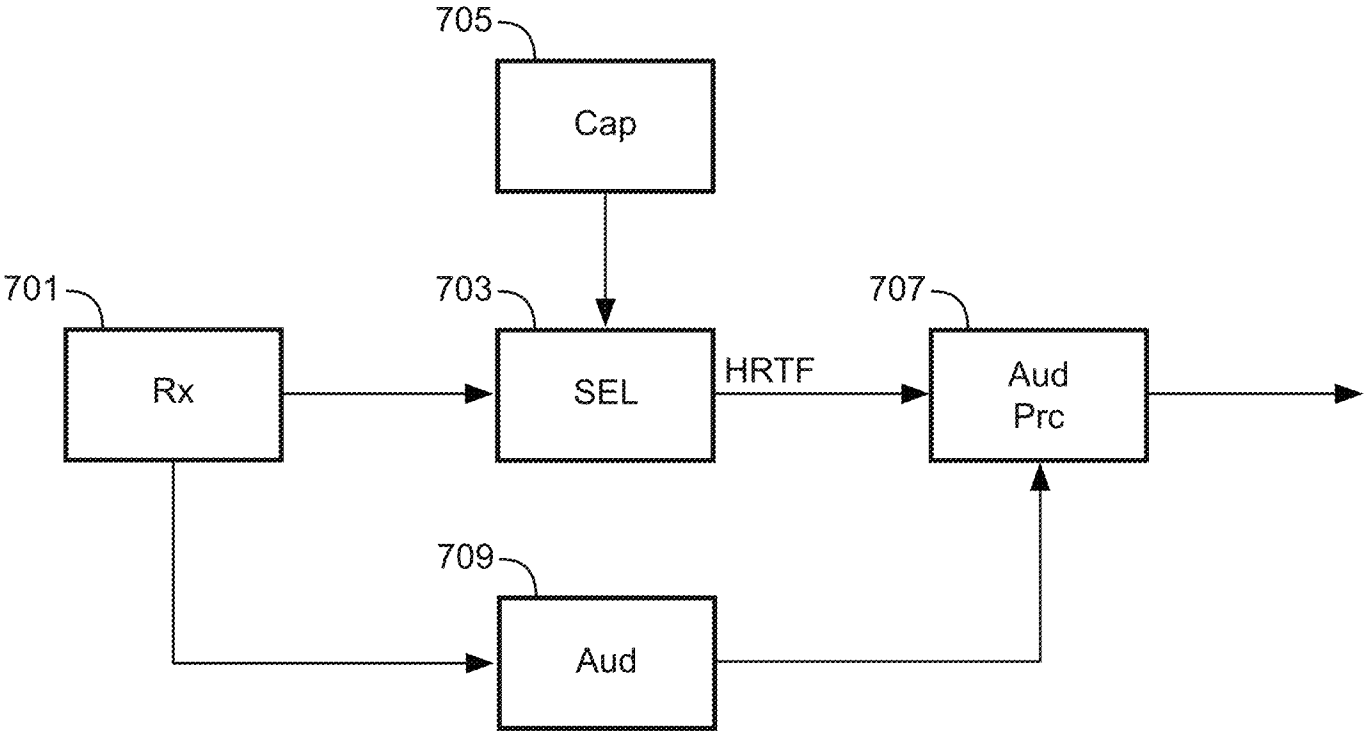
FIG. 7 illustrates an example of a receiver of head related binaural transfer function data in accordance with some embodiments of the invention.

FIG. 7 illustrates a receiving device in accordance with some embodiments of the invention.

The receiving device comprises a receiver 701 which receives a bitstream as described above, i.e. it may specifically receive the bitstream from the transmitting device of FIG. 6.

The receiver 701 is coupled to a selector 703 which is fed the received binaural rendering data sets and the associated representation indications. The selector 703 is in the example coupled to a capability processor 705 which is arranged to provide the selector 703 with data that describes capabilities of the audio processing capability of the receiving device. The selector 703 is arranged to select at least one of the binaural rendering data sets based on the representation indications and the capability data received from the capability processor 705. Thus, at least one selected binaural rendering data set is determined by the selector 703.

The selector 703 is further coupled to an audio processor 707 which receives the selected binaural rendering data. The audio processor 707 is further coupled to an audio decoder 709 which is further coupled to the receiver 701.

In the example where the bitstream comprises audio data for audio to be rendered, this audio data is provided to the audio decoder 709 which proceeds to decode it to generate individual audio components, such as audio objects and/or audio channels. These audio components are fed to the audio processor 707 together with a desired sound source position for the audio component.

The audio processor 707 is arranged to process one or more audio signals/components based on the extracted binaural data, and specifically in the described example based on the extracted HRTF data.

As an example, the selector 703 may extract one HRTF data set for each position provided in the bitstream. The resulting HRTFs may be stored in local memory, i.e. one HRTF may be stored for each of a set of positions. When rendering a specific audio signal, the audio processor 707 receives the corresponding audio data from the audio detector 709 together with the desired position. The audio processor 707 then evaluates the position to see if it matches any of the stored HRTFs sufficiently closely. If so, it applies this HRTF to the audio signal to generate a binaural audio component. If none of the stored HRTFs are for a position which is sufficiently close, the audio processor 707 may proceed to extract the two closest HRTFs and interpolate between these to get a suitable HRTF. The approach may be repeated for all the audio signals/components, and the resulting binaural output data may be combined to generate binaural output signals. These binaural output signals may then be fed to e.g. headphones.

It will be appreciated that different capabilities may be used for selecting the appropriate data set(s). For example, the capability may be at least one of a computational resource, a memory resource, or a rendering algorithm requirement or restriction.

For example, some renderers may have significant computational resource capability which allows it to perform many high complexity operations. This may allow a binaural rendering algorithm to use complex binaural filtering. Specifically, filters with long impulse responses (e.g. FIR filters with many taps) can be processed by such devices. Accordingly, such a receiving device may extract an HRTF which is represented by a FIR filter with many taps and with many bits for each tap.

However, another renderer may have a low computational resource capability which prevents the binaural rendering algorithm from using complex filter operations. For such a rendering, the selector 703 may select a data set representing the HRTF by a FIR filter with few taps and with a coarse resolution (i.e. fewer bits per tap).

As another example, some renderers may have sufficient memory to store large amounts of HRTF data. In this case, the selector 703 may select HRTF data sets which are large, e.g. with many coefficients and with many bits per coefficient. However, for renderers with low memory resources, this data cannot be stored, and accordingly the selector 703 may select an HRTF data set which is much smaller, such as one with substantially fewer coefficients and/or fewer bits per coefficient.

In some embodiments, the capability of the available binaural rendering algorithms may be taken into account. For example, an algorithm is typically developed to be used with HRTFs that are represented in a given way. E.g. some binaural rendering algorithms use binaural filtering based on QMF data, others use impulse response data, and yet other use FFT data etc. The selector 703 may take the capability of the individual algorithm that is to be used into account, and may specifically select the data sets to represent the HRTFs in a way that matches that used in the specific algorithm.

Indeed, in some embodiments, at least some of the representation indications/data sets relate to different binaural audio processing algorithms, and the selector 703 may select the data set(s) based on the binaural processing algorithm used by the audio processor 707.

E.g. if the binaural processing algorithm is based on frequency domain filtering, the selector 703 may select a data set representing the HRTF in a corresponding frequency domain. If the binaural processing algorithm includes convolving the audio signal being processed with a FIR filter, the selector 703 may select a data set providing a suitable FIR filter, etc.

In some embodiments, the capability indications used to select the appropriate data set(s) may be indicative of a constant, predetermined or static capability. Alternatively or additionally, the capability indications may in some embodiments be indicative of a dynamic/varying capability.

For example, the computational resource available for the rendering algorithm may be dynamically determined, and the data set may be selected to reflect the current available resource. Thus, larger, more complex and more resource demanding HRTF data set may be selected when there is a large amount of available computational resource, whereas a smaller, less complex and less resource demanding HRTF data set may be selected when there is less resource available. In such a system, the quality of the binaural rendering may be increased whenever possible while allowing a trade-off between quality and computational resource when the computational resource is needed for other (more important) functions.

The selection of a selected binaural rendering data set by the selector 703 is based on the representation indications rather than on the data itself. This allows for a much simpler and effective operation. In particular, the selector 703 does not need to access or retrieve any of the data of the data sets but can simply extract the representation indications. As these are typically much smaller than the data sets and typically have a much simpler structure and syntax, this may simplify the selection process substantially, thereby reducing the computational requirement for the operation.

The approach thus allows for a very flexible distribution of binaural data. Specifically, a single file of HRTF data can be distributed which can support a variety of rendering devices and algorithms. Optimization of the process can be performed locally by the individual renderer to reflect the specific circumstances of that renderer. Thus, improved performance and flexibility for distributing binaural information is achieved.

A specific example of a suitable data syntax for the bitstream is provided below. In this example, the field 'bsRepresentationID' provides an indication of the HRTF format.

In more detail, the following fields are used:

ByteAlign( ) Up to 7 fill bits to achieve byte alignment with respect to the beginning of the syntactic element in which ByteAlign( ) occurs.

bsFileSignature A string of 4 ASCII characters that reads "HRTF".

bsFileVersion File version indication.

bsNumCharName Number of ASCII characters in the HRTF name.

bsName HRTF name.

bsNumFs Indicates that the HRTF is transmitted for bsNumFs+1 different samplerates.

bsSamplingFrequency Sample frequency in Hertz.

bsReserved Reserved bits.

Positions Indicates position information for the virtual speakers transmitted in the HRTF data.

bsNumRepresentations Number of representations transmitted for the HRTF bsRepresentationlD Identifies the type of HRTF representation that is transmitted. Each ID can only be used once per HRTF. For example, the following available IDs may be used:

| bsRepresentationID | Description |
|---|---|
| 0 | FIR filters, either as time domain impulse response or as FFT domain single sided spectrum. |
| 1 | Parametric representation of the filters. With levels, ICC and IPD per frequency band. |
| 2 | QMF-based filtering approach as used in MPEG Surround. |
| 3 . . . 14 | Reserved |
| 15 | Allows transmission in a custom format. |

In this specific example, the following file format/syntax may be used for the bitstream:

| Syntax | No. of bits | Mnemonic |
|---|---|---|
| CustomHrtfFile( ) | | |
| { | | |
| bsFileSignature; | 32 | bslbf |
| bsFileVersion; | 8 | uimsbf |
| bsNumCharName; | 8 | uimsbf |
| for ( i=0; i<bsNumCharName; i++ ) { | | |
| bsName[i]; | 8 | bslbf |
| } | | |
| bsNumFs; | 3 | |
| for (fs = 0; fs < bsNumFs + 1; fs++) { | | |
| bsSamplingFrequency[fs]; | 32 | ieeesf |
| } | | |
| bsReserved; | 5 | bslbf |
| (numPositions, azimuth, elevation, distance) = Positions( ); | | |
| bsNumHrtfRepresentations; | 4 | uimsbf |
| for (r = 0; r < bsNumHrtfRepresentations; r++) | | |
| { | | |
| switch (bsHrtfRepresentationID) { | 4 | uimsbf |
| case 0: /* FIR */ | | |
| FirHeader( ); | | |
| FirData( ); | | |
| break; | | |
| case 1: /* Parametric */ | | |
| ParametricHeader( ); | | |
| ParametricData( ); | | |
| break; | | |
| case 2: /* Filtering */ | | |
| FilteringHeader( ); | | |
| FilteringData( ); | | |
| break; | | |
| case 15: /* Custom */ | | |

-continued

| Syntax | No. of bits | Mnemonic |
|---|---|---|
| CustomHRTFHeader( ); | | |
| CustomHRTFData( ); | | |
| } | | |
| } | | |
| } | | |

In some embodiments, the binaural rendering data sets may comprise reverberation data. The/selector 703 may accordingly select a reverberation data set and feed this to the audio processor 707 which may proceed to adapt a process affecting the reverberation of the audio signal(s) dependent on this reverberation data.

Many binaural transfer functions include both an anechoic part followed by a reverberation part. Particular functions that include characteristics of the room, such as BRIRs or BRTFs, consist of an anechoic portion that depends on the subject's anthropometric attributes (such as head size, ear shape, etc.), (i.e. the basic HRIR or HRTF) followed by a reverberant portion that characterizes the room.

The reverberant portion contains two temporal regions, usually overlapping. The first region contains so-called early reflections, which are isolated reflections of the sound source on walls or obstacles inside the room before reaching the ear-drum (or measurement microphone). As the time lag increases, the number of reflections present in a fixed time interval increases, with the reflections further containing secondary reflections etc. The second region in the reverberant portion is the part where these reflections are no longer isolated. This region is called the diffuse or late reverberation tail.

The reverberant portion contains cues that give the auditory system information about distance between the source and the receiver (i.e. the position where the BRIRs were measured) and the size and acoustical properties of the room. The energy of the reverberant portion in relation to that of the anechoic portion largely determines the perceived distance of the sound source. The temporal density of the (early-) reflections contributes to the perceived size of the room. Typically indicated by T60, reverberation time is the time that it takes for reflections to drop 60 dB in energy level. The reverberation is caused by a combination of room dimensions and the reflective properties of the boundaries of the room. Very reflective walls (e.g. bathroom) will require more reflections before the level is 60 dB reduced that when there is much absorption of sound (e.g. bed-room with furniture, carpet and curtains). Similarly, large rooms have longer traveling paths between reflections and therefore increase the time before a level reduction of 60 dB is achieved than in a smaller room with similar reflective properties.

Figure 8:
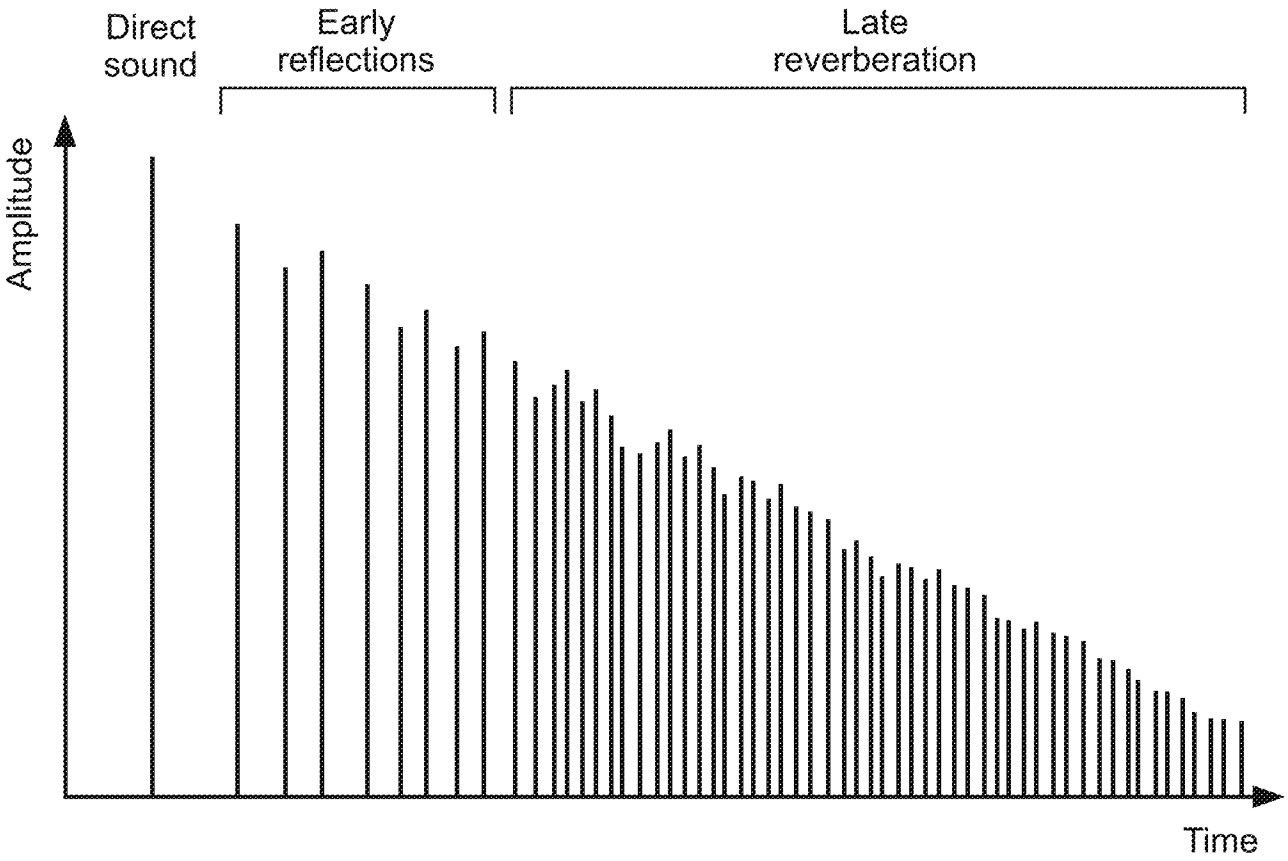
FIG. 8 illustrates an example of a head related binaural transfer function.

An example of a BRIR including a reverberation part is illustrated in FIG. 8.

The head related binaural transfer function may in many embodiments reflect both the anechoic part and the reverberation part. E.g. an HRTF may be provided which reflects the impulse response illustrated in FIG. 8. Thus, in such embodiments, the reverberation data is part of the HRTF and the reverberation processing is an integral process of the HRTF filtering.

However, in other embodiments, the reverberation data may be provided at least partly separately from the anechoic part. Indeed, a computational advantage in rendering e.g. BRIRs can be obtained by splitting the BRIR into the anechoic part and the reverberant part. The shorter anechoic filters can be rendered with a significantly lower computational load than the long BRIR filters and requires substantially less resource for storing and communication. The long reverb filters may in such embodiments be implemented more efficiently using synthetic reverberators.

Figure 9:
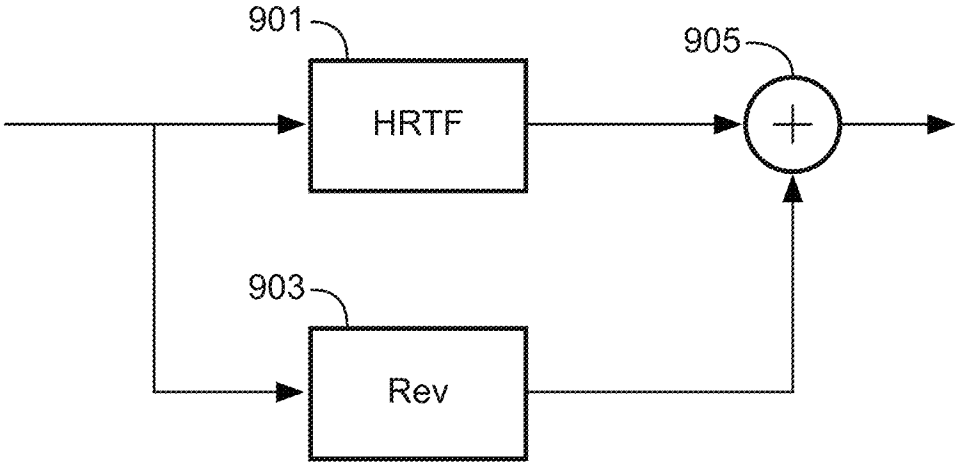
FIG. 9 illustrates an example of a binaural processor.

An example of such a processing of an audio signal is illustrated in FIG. 9. FIG. 9 illustrates the approach for generating one signal of the binaural signals. A second processing may be performed in parallel to generate the second binaural signal.

In the approach of FIG. 9, the audio signal to be rendered is fed to an HRTF filter 901 which applies a short HRTF filter reflecting typically the anechoic and (some of the) early reflection part of the BRIR. Thus, this HRTF filter 901 reflects the anatomical characteristics as well as some early reflections caused by the room. In addition, the audio signal is coupled to a reverberator 903 which generates a reverberation signal from the audio signal.

The output of the HRTF filter 901 and the reverberator 903 are then combined to generate an output signal. Specifically, the outputs are added together to generate a combined signal that reflects both the anechoic and early reflections as well as the reverberation characteristics.

Figure 10:
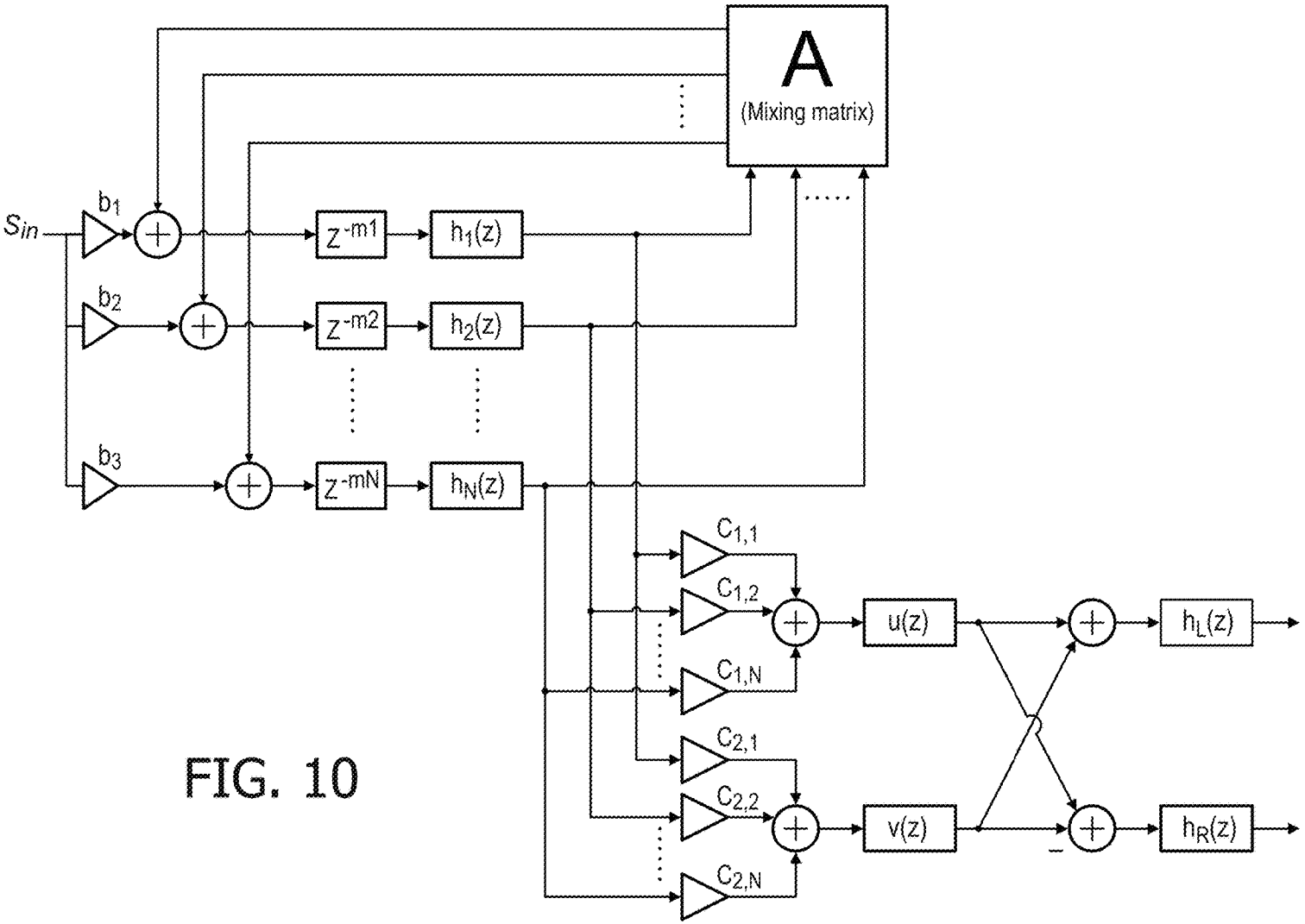
FIG. 10 illustrates an example of a modified Jot reverberator.

The reverberator 903 is specifically a synthetic reverberator, such as a Jot reverberator. A synthetic reverberator typically simulates early reflections and the dense reverberation tail using a feedback network. Filters included in the feedback loops control reverberation time ($T_{60}$) and coloration. FIG. 10 illustrates an example of a schematic depiction of a modified Jot reverberator (with three feedback loops) outputting two signals instead of one such that it can be used for representing binaural reverbs. Filters have been added to provide control over interaural correlation (u(z) and v(z)) and ear-dependent coloration ($h_L$ and $H_R$).

In the example, the binaural processing is thus based on two individual and separate processes that are performed in parallel and with the output of the two processes then being combined into the binaural signal(s). The two processes can be guided by separate data, i.e. the HRTF filter 901 may be controlled by HRTF filter data and the reverberator 903 may be controlled by reverberation data.

In some embodiments, the data sets may comprise both HRTF filter data and reverberation data. Thus, for a selected data set, the HRTF filter data may be extracted and used to set up the HRTF filter 901 and the reverberation data may be extracted and used to adapt the processing of the reverberator 903 to provide the desired reverberation. Thus, in the example the reverberation processing is adapted based on the reverberation data of the selected data set by independently adapting the processing that generates the reverberation signal.

In some embodiments, the received data sets may comprise data for only one of the HRTF filtering and the reverberation processing. For example, in some embodiments, the received data sets may comprise data which defines the anechoic part as well as an initial part of the early reflections. However, a constant reverberation processing may be used independently of which data set is selected, and indeed typically independently of which position is to be rendered (reverberation is typically independent of sound source positions as it reflects many reflections in the room). This may result in a lower complexity processing and operation and may in particular be suitable for embodiments wherein the binaural processing may be adapted to e.g. individual listeners but with the rendering being intended to reflect the same room.

In other embodiments, the data sets may include reverberation data without HRTF filtering data. For example, HRTF filtering data may be common for a plurality of data sets, or even for all data sets, and each data set may specify reverberation data corresponding to different room characteristics. Indeed, in such embodiments, the HRTF filtered signal may not be dependent on data of the selected data set. The approach may be particularly suitable for applications wherein the processing is for the same (e.g. nominal) listener but with the data allowing different room perceptions to be provided.

In the examples, the selector 703 may select the data set to use based on the indications of representations of reverberation data as indicated by the representation indications. Thus, the representation indications may provide an indication of how the reverberation data is represented by the data sets. In some embodiments, the representation indications may include such indications with indications of the HRTF filtering whereas in other embodiments the representation indications may e.g. only include indications of the reverberation data.

For example, the data sets may include representations corresponding to different types of synthetic reverberators, and the selector 703 may be arranged to select the data set for which the representation indications indicates that the data set comprises data for a reverberator matching the algorithm that is employed by the audio processor 707.

In some embodiments, the representation indications represent an ordered sequence of the binaural rendering data set. For example, the data sets (for a given position) may correspond to an ordered sequence in order of quality and/or complexity. Thus, a sequence may reflect an increasing (or decreasing) quality of the binaural processing defined by the data sets. The indication processor 603 and/or the output processor 605 may generate or arrange the representation indications to reflect this order.

The receiver may be aware of which parameter the ordered sequence reflects. E.g. it may be aware that the representation indications indicate a sequence of increasing (or decreasing) quality or decreasing (or increasing) complexity. The selector 703 can then use this knowledge when selecting the data set to use for the binaural rendering. Specifically, the selector 703 may select the data set in response to the positions of the data set in the ordered sequence.

Such an approach may in many scenarios provide a lower complexity approach, and may in particular facilitate the selection of the data set(s) to use for the audio processing. Specifically, if the selector 703 is arranged to evaluate the representation indications in the given order (corresponding to considering the data sets in the sequence in which they are ordered), it may in many embodiments and scenarios not need to process all representation indications in order to select the appropriate data set(s).

Indeed, the selector 703 may be arranged to select the binaural rendering data set as the binaural rendering data set for the first (earliest) data set in the sequence for which the representation indication is indicative of a rendering processing of which the audio processor is capable.

As a specific example, the representation indications/data sets may be ordered in order of decreasing quality of the rendering process that the data of the data sets represent. By evaluating the representation indications in this order and selecting the first data set that the audio processor 707 is able to handle, the selector 703 can stop the selection process as soon as a representation indication is encountered which indicates that the corresponding data set has data which is suitable for use by the audio processor 707. The selector 703 need not consider any further parameters as it will know that this data set will result in the highest quality rendering.

Similarly, in systems wherein complexity minimization is desired, the representation indications may be ordered in order of increasing complexity. By selecting the data set of the first representation indication which indicates a suitable representation for the processing of the audio processor 707, the selector 703 can ensure that the lowest complexity binaural rendering is achieved.

It will be appreciated that in some embodiments, the ordering may be in order of increasing quality/decreasing complexity. In such embodiments, the selector 703 may e.g. process the representation indications in reverse order to achieve the same result as described above.

Thus, in some embodiments, the order may be in order of decreasing quality of the binaural rendering represented by the binaural rendering data sets and in others it may be in order of increasing quality of the binaural rendering represented by the binaural rendering data sets. Similarly, in some embodiments, the order may be in order of decreasing complexity of the binaural rendering represented by the binaural rendering data sets, and in other embodiments it may be in order of increasing complexity of the binaural rendering represented by the binaural rendering data sets.

In some embodiments, the bitstream may include an indication of which parameter the order is based on. For example, a flag may be included which indicates whether the order is based on complexity or quality.

In some embodiments, the order may be based on a combination of parameters, such as e.g. a value representing a compromise between complexity and quality. It will be appreciated that any suitable approach for calculating such a value may be used.

Different measures may be used to represent a quality in different embodiments. For example, a distance measure may be calculated for each representation indicating the difference (e.g. the mean square error) between the accurately measured head related binaural transfer function and the transfer function that is described by the parameters of the individual data set. Such a difference may include an effect of both quantizations of the filter coefficients as well as a truncation of the impulse response. It may also reflect the effect of the discretization in the time and/or frequency domain (e.g. it may reflect the sample rate or the number of frequency bands used to describe the audio band). In some embodiments, the quality indication may be a simple parameter, such as for example the length of the impulse response of a FIR filter.

Similarly, different measures and parameters may be used to represent a complexity of the binaural processing associated with a given data set. In particular, the complexity may be a computational resource indication, i.e. the complexity may reflect how complex the associated binaural processing may be to perform.

In many scenarios, parameters may typically indicate both increasing quality and increasing complexity. For example, the length of a FIR filter may indicate both that quality increases and that complexity increases. Thus, in many embodiments, the same order may reflect both complexity and quality, and the selector 703 may use this when selecting. For example, it may select the highest quality data set as long as the complexity is below a given level. Assuming that the representation indications are arranged in terms of decreasing quality and complexity, this may be achieved simply by processing the representation indications and selecting the data set of the first indication which represents a complexity below the desired level (and which can be handled by the audio processor).

In some embodiments, the order of the representation indications and associated data sets may be represented by the positions of the representation indications in the bitstream. E.g., for an order reflecting decreasing quality, the representation indications (for a given position) may simply be arranged such that the first representation indication in the bitstream is the one which represents the data set with the highest quality of the associated binaural rendering. The next representation indication in the bitstream is the one which represents the data set with the next highest quality of the associated binaural rendering etc. In such an embodiment, the selector 703 may simply scan the received bitstream in order and may for each representation indication determine whether it indicates a data set that the audio processor 707 is capable of using or not. It can proceed to do this until a suitable indication is encountered at which no further representation indications of the bit stream need to be processed, or indeed decoded.

In some embodiments, the order of the representation indications and associated data sets may be represented by an indication comprised in the input data, and specifically the indication for each representation indication may be comprised in the representation indication itself.

For example, each representation indication may include a data field which indicates a priority. The selector 703 may first evaluate all representation indications which include an indication of the highest priority and determine if any indicate that useful data is comprised in the associated data set. If so, this is selected (if more than one are identified, a secondary selection criterion may be applied, or e.g. one may just be selected at random). If none are found, it may proceed to evaluate all representation indications indicative of the next highest priority etc. As another example, each representation indication may indicate a sequence position number and the selector 703 may process the representation indications to establish the sequence order.

Such approaches may require more complex processing by the selector 703 but may provide more flexibility, such as e.g. allowing a plurality of representation indications to be prioritized equally in the sequence. It may also allow each representation indication to be positioned freely in the bitstream, and specifically may allow each representation indication to be included next to the associated data set.

The approach may thus provide increased flexibility which e.g. facilitate the generation of the bitstream. For example, it may be substantially easier to simply append additional data sets and associated representation indications to an existing bitstream without having to restructure the entire stream.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. An apparatus for processing an audio signal, the apparatus comprising:

a receiver, the receiver configured to receive input data,
- wherein the input data comprises a plurality of binaural rendering data sets,
- wherein each binaural rendering data set comprises a second data,
- wherein the second data represents parameters for a virtual position binaural rendering processing,
- wherein the second data provides a different representation of a same underlying head related binaural transfer function,
- wherein for each of the binaural rendering data sets, the input data further comprises a representation indication,
- wherein the representation indication is indicative of a representation for the binaural rendering data set;

a selector,
- wherein the selector is configured to select a binaural rendering data set from the plurality of binaural rendering data sets,
- wherein the selected binaural rendering data set is dependent on a binaural processing algorithm used by an audio processor and the representation indications, wherein the audio processor is configured to process the audio signal in response to the second data of the selected binaural rendering data set, wherein at least some representations for the binaural rendering data sets correspond to different binaural audio processing algorithms.

2. The apparatus of claim 1 wherein the binaural rendering data sets comprise head related binaural transfer function data.

3. The apparatus of claim 2 wherein at least one of the binaural rendering data sets comprises head related binaural transfer function data for a plurality of positions.

4. The apparatus of claim 1 wherein the representation indications further represent an ordered sequence of the binaural rendering data set, the ordered sequence being ordered in terms of at least one of quality and complexity for a binaural rendering represented by the binaural rendering data sets, and the selector is configured to select the selected binaural rendering data set in response to a position of the selected binaural rendering data set in the ordered sequence.

5. The apparatus of claim 4 wherein the selector is configured to select the selected binaural rendering data set as the binaural rendering data set for the selected representation indication in the ordered sequence which indicates a rendering processing of which the audio processor is capable.

6. The apparatus of claim 1 wherein the representation indications comprise an indication of a head related filter type represented by the binaural rendering data set.

7. The apparatus of claim 1, wherein at least some of the plurality of binaural rendering data sets includes at least one head related binaural transfer function described by a representation selected from a group consisting of: a time domain impulse response representation, a frequency domain filter transfer function representation, a parametric representation, and a sub-band domain filter representation.

8. The apparatus of claim 1, wherein at least some binaural rendering data sets comprise reverberation data, wherein the audio processor is configured to adapt a reverberation processing dependent on the reverberation data of the selected binaural rendering data set.

9. The apparatus of claim 8 wherein the audio processor is configured to perform a binaural rendering processing, wherein the binaural rendering processing includes generating a processed audio signal, wherein the processed audio signal is a combination of at least a head related binaural transfer function filtered signal and a reverberation signal, wherein the reverberation signal is dependent on the second data of the selected binaural rendering data set.

10. The apparatus of claim 8 wherein the selector is configured to select the selected binaural rendering data set in response to indications of representations of reverberation data as indicated by the representation indications.

11. An apparatus for generating a bitstream, the apparatus comprising:

a binaural circuit, wherein the binaural circuit is arranged to provide a plurality of binaural rendering data sets, wherein each binaural rendering data set comprises a second data, wherein the second data represents parameters for a virtual position binaural rendering processing, wherein the second data provides a different representation of a same underlying head related binaural transfer function;

a representation circuit configured to provide, a representation indication indicative of a representation for the binaural rendering data set for each of the binaural rendering data sets; and an output circuit configured to generate a bitstream, wherein the bitstream comprises the binaural rendering data sets and the representation indications, wherein at least some representations for the binaural rendering data sets correspond to different binaural audio processing algorithms.

12. The apparatus of claim 11 wherein the output circuit is configured to order the representation indications in order of a measure of a characteristic of a virtual position binaural rendering represented by the parameters of the binaural rendering data sets.

13. A method, operable in an apparatus, of processing audio, the method comprising:

receiving input data, wherein the input data comprises a plurality of binaural rendering data sets, wherein each binaural rendering data set comprises a second data representing parameters for a virtual position binaural rendering processing, wherein the second data provides a different representation of a same underlying head related binaural transfer function, wherein the input data further comprises, for each of the binaural rendering data sets, a representation indication, wherein the representation indication is indicative of a representation for the binaural rendering data set;

selecting a binaural rendering data set from the plurality of binaural rendering data sets in response to the representation indications and a binaural processing algorithm used by the apparatus; and processing an audio signal in response to the second data of the selected binaural rendering data set, wherein at least some representations for the binaural rendering data sets correspond to different binaural audio processing algorithms.

14. A device for generating a bitstream, the device executing a method comprising:

providing a plurality of binaural rendering data sets, wherein each binaural rendering data set comprises a second data, wherein said second data represents parameters for a virtual position binaural rendering processing, wherein said second data provides a different representation of a same underlying head related binaural transfer function, providing, for each of the binaural rendering data sets, a representation indication, wherein said representation indication is indicative of a representation for the binaural rendering data set;

generating a bitstream comprising the binaural rendering data sets and the representation indication, wherein at least some representations for the binaural rendering data sets correspond to different binaural audio processing algorithms.

15. A device for generating a bitstream, said bitstream comprising:

a plurality of binaural rendering data sets, wherein each binaural rendering data set comprises a second data, wherein said second data represents parameters of at least one binaural virtual position rendering processing, wherein said second data provides a different representation of a same underlying head related binaural transfer function; and a representation indication for each of the binaural rendering data sets, the representation indication for a binaural rendering data set being indicative of a representation used by the binaural rendering data set, wherein at least some representations for the binaural rendering data sets correspond to different binaural audio processing algorithms.

* * * * *